US006851433B1

(12) United States Patent
Gross et al.

(10) Patent No.: US 6,851,433 B1
(45) Date of Patent: Feb. 8, 2005

(54) ALL PURPOSE SPRAY CLEANER COMPOSITIONS AND CONCENTRATES THEREFOR

(75) Inventors: Stephen F. Gross, Souderton, PA (US); Robert J. Valesky, Hatboro, PA (US); Timothy C. Morris, Morton, PA (US)

(73) Assignee: Cognis Corporation, Ambler, PA (US)

( * ) Notice: Subject to any disclaimer, the term of this patent is extended or adjusted under 35 U.S.C. 154(b) by 267 days.

(21) Appl. No.: 10/284,871

(22) Filed: Oct. 31, 2002

Related U.S. Application Data

(60) Provisional application No. 60/335,911, filed on Nov. 2, 2001.

(51) Int. Cl.[7] ..... B08B 3/04; C11D 1/722; C11D 3/24; C11D 3/37

(52) U.S. Cl. ..... 134/25.2; 134/39; 134/40; 134/42; 422/28; 422/37; 510/199; 510/238; 510/239; 510/240; 510/365; 510/370; 510/379; 510/470

(58) Field of Search ..... 510/199, 238, 510/239, 240, 365, 370, 379, 470; 134/25.2, 39, 40, 42; 422/28, 37

(56) References Cited

U.S. PATENT DOCUMENTS

| | | | | |
|---|---|---|---|---|
| 5,827,453 | A | 10/1998 | Gross et al. | |
| 5,895,605 | A | 4/1999 | Gross et al. | |
| 6,110,977 | A | 8/2000 | Gross et al. | |
| 6,532,973 | B1 * | 3/2003 | Gross et al. | 134/25.2 |

* cited by examiner

*Primary Examiner*—Brian P Mruk
(74) *Attorney, Agent, or Firm*—Aaron R. Ettelman

(57) ABSTRACT

Aqueous liquid concentrates for use when diluted as all purpose spray cleaners comprising the following components:

A) from about 3 to about 10% by weight of at least one base-catalyzed reaction product comprised of the following reactants:

(i) at least one compound of formula I:

$$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and (ii) at least one compound having the formula II:

$$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_8$ alkyl group; each AO group is independently an ethyleneoxy, 1,2-propyleneoxy, or 1,2-butyleneoxy group, n is a number of from 0 to 200; and Y is hydrogen, or Y can be a mercapto group, an amino group, or a $C_1$–$C_6$ alkylamino group in place of a terminal —OH group, provided that when Y is mercapto, amino, or a $C_1$–$C_6$ alkylamino group, n is at least 1;

B) from about 15 to about 45% by weight of at least one alkyl polyglycoside;

C) from about 3 to about 20% by weight of at least one builder; provided that the total quantity of nonaqueous components is from about 25 to about 60% by weight; and wherein the concentrate does not contain any volatile organic solvents.

56 Claims, No Drawings

ALL PURPOSE SPRAY CLEANER COMPOSITIONS AND CONCENTRATES THEREFOR

CROSS-REFERENCE TO RELATED APPLICATIONS

This application claims the benefit of copending provisional application Ser. No. 60/335,911, filed on Nov. 2, 2001, the entire contents of which are incorporated herein by reference.

FIELD OF THE INVENTION

This invention relates to all purpose spray cleaners and to concentrates which can be diluted to produce the all purpose spray cleaners.

BACKGROUND OF THE INVENTION

Typical all purpose spray cleaners contain from 4 to 5% by weight of glycol ether, as well as alkaline builders and surfactants. Due to the above components, single phase, uniform, and stable concentrates having more than a 5 or 10 times concentration have not been possible, since incompatibility and insufficient solubility of these three components will occur in higher concentrations. For example, in order to produce a single phase, uniform, and stable 50× concentrate, the glycol ether component would either have to be removed or at least drastically reduced, resulting in a marked reduction in the cleaning performance of the use dilution.

SUMMARY OF THE INVENTION

This invention relates to organic solvent-free all purpose spray cleaner compositions and concentrates therefor which are highly concentrated, e.g. to from 25 to 50 times, without any change in the formulation, and wherein the concentrates are single phase, uniform, and stable free flowing liquids, and can be readily diluted with water without any tendency to gel.

The organic solvent-free concentrates of the invention are comprised of the following components:

| Component | % by weight |
|---|---|
| Surfactant 1 | 3 to 10, preferably 5 to 8 |
| Surfactant 2 | 15–45, preferably 25–35 |
| builders | 3 to 20, preferably 9 to 18 |
| water | remainder; |

provided that the total quantity of nonaqueous components is from 25 to 60% by weight, preferably from 40 to 50% by weight.

DETAILED DESCRIPTION OF THE INVENTION

Other than in the operating examples, or where otherwise indicated, all numbers expressing quantities of ingredients or reaction conditions used herein are to be understood as modified in all instances by the term "about".

The Surfactant 1 component is at least one base-catalyzed reaction product of reactants comprising:

A) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and B) at least one compound having the formula II $$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$ alkyl group; each AO group is independently an ethyleneoxy, 1,2-propyleneoxy, or 1,2-butyleneoxy group, n is a number of from 0 to 200, preferably from 1 to 100, more preferably from 2 to 20; and Y is hydrogen, or Y can be a mercapto group or an amino group (amino or $C_1$–$C_6$ alkylamino group) in place of a terminal —H group, provided that when Y is mercapto, amino, or a $C_1$–$C_6$ alkylamino group, n is at least 1.

The mole ratio of the linking compound (I) to (II) is from 0.1:1 to 5:1, preferably from 0.6:1 to 2:1, more preferably from 0.8:1 to 2:1, and most preferably from 1.0:1 to 1.5:1.

In the above compounds of component A), the linking compound of formula I is preferably epichlorohydrin or another epihalohydrin. Also, trihaloalkanes can be used, such as 1,2,3-trichloropropane, 1,2,4-trichlorobutane, 1,3,6-trichlorohexane, and the like. Instead of chlorine in the epichlorohydrins and the trihaloalkanes, the corresponding bromine and iodine compounds can also be used, including compounds containing two or even all three of the above halogens.

The component B) compounds of formula II are organic (optionally alkoxylated) alcohols or the corresponding sulfhydryl or amine compounds.

The $R^2$ group can be a substituted or unsubstituted, saturated or unsaturated hydrocarbon group having from 1 to 36 carbon atoms. Examples of such hydrocarbon groups include linear or branched alkyl groups having from 1 to 36 carbon atoms, preferably from 4 to 22 carbon atoms, linear or branched alkenyl or alkynyl groups having from 2 to 36 carbon atoms, preferably from 4 to 22 carbon atoms, aryl groups having from 6 to 22 carbon atoms, and arenyl groups having from 7 to 36 carbon atoms. Arenyl groups are alkyl-substituted aromatic radicals having a free valance at an alkyl carbon atom such as a benzylic group.

The $R^2$ group can also be a saturated carbocyclic group, an unsaturated carbocyclic group having one or more multiple bonds, a saturated heterocyclic group, or an unsaturated heterocyclic group having one or more multiple bonds. Any of the above $R^2$ groups can be substituted groups, i.e. the groups can be single or multiple substituents such as one or more halogen substituents, for example Cl, F, I, and Br; a sulfur functionality such as a mercaptan or thio group; a nitrogen functionality such as an amine or amide functionality; an alcohol functionality, a silicon functionality, e.g., a siloxane; an ether functionality, e.g. a $C_1$–$C_6$ alkoxy group; or any combination thereof.

The $R^2$ group in formula II is preferably a branched chain alkyl group containing from 4 to 36 carbon atoms, preferably from 4 to 12 carbon atoms, and more preferably from 8 to 10 carbon atoms.

When the X group of formula II is an —S—group, the $R^2$ group will preferably have from about 4 to about 22 carbon atoms, examples of which include but are not limited to, dodecyl mercapto and 1-hexadecanethio.

When the $R^2X$—group of formula H is a secondary or tertiary amino group, the group preferably contains from 4 to 22 carbon atoms, and n is preferably a number of from 4 to 50. Examples of primary and secondary amines useful for obtaining the $R^2X$—group include, but are not limited to, dibutyl amine, cyclohexyl amine, isodecyl amine, and dioctylamine.

When Y in formula II is an amine or sulfhydryl group, the resulting compounds can be readily prepared from the corresponding alcohols wherein the terminal hydroxy group is replaced by an —SH group or by an amine nitrogen. For example, a compound of formula II where Y is —OH can be subjected to a catalyzed ammoniation (with ammonia, or a lower alkylamine) for replacement of the hydroxyl.

In the compounds of formula II, the AO groups when present are preferably all ethyleneoxy groups. However, as stated above, each OA group can be independently an ethyleneoxy (EO), 1,2-propyleneoxy (PO), 1,2-butyleneoxy (BO) group, i.e. any one or more of such groups can be present, and they can be present in any order, as well as be present in blocks, e.g. compounds of formula III:

$$R^2O(EO)_m(PO)_p(BO)_qH \quad \text{(III)}$$

wherein $R^2$ has the meaning given above, m is a number of from 0 to 100, preferably from 1 to 50, p is a number of from 0 to 50, and q is a number of from 0 to 50. Compounds of formula III in which $R^2$ is a branched chain alkyl group having from 4 to 12 carbon atoms, m is a number of from 2 to 20, and p and q are 0 are preferred. The most preferred compound is the reaction product of epichlorohydrin and isodecyl alcohol—4EO, marketed by Cognis Corporation Ambler, PA, 19002 as DEHYPOUND® ST-15.

The degree of hydrophilic and hydrophobic properties of the reaction products of components A) and B) can be readily controlled by controlling the type and number of alkyleneoxy groups in component B). For example, the greater the number of ethyleneoxy groups present, the greater the water solubility, while the presence of 1,2-propyleneoxy groups and/or 1,2-butyleneoxy groups for example, will decrease water solubility.

In general, the compounds of formula III wherein the sum of n, m, and p is at least 1, and especially at least 2 or 3 are preferred for use herein.

The above reaction products can be prepared by the process disclosed in U.S. Pat. No. 5,827,453, the disclosure of which is expressly incorporated herein by reference.

In general, the component A) and B) reactants are reacted together, preferably in the presence of an inert organic solvent such as toluene that will azeotrope water, and in the presence of a base, such as aqueous sodium hydroxide, at a temperature of from 60° to 125° C. Preferably component B) is first mixed with the base and the organic solvent, and water is removed by azeotropic distillation. Then component A) is slowly added and the reaction continued until the reaction is completed. The reaction mixture is filtered and vacuum stripped to remove the organic solvent.

Surfactant 2 is at least one alkyl polyglycoside having formula IV below:

$$R_1O(R_2O)_b(Z)_a \quad \text{(IV)}$$

wherein $R_1$ is a monovalent organic radical having from about 6 to about 30 carbon atoms, preferably from 6 to 12 carbon atoms, and more preferably having an average of from 10 to 10.5 carbon atoms; $R_2$ is a divalent alkylene radical having from 2 to 4 carbon atoms; Z is saccharide residue having 5 or 6 carbon atoms; b is a number having a value from 0 to about 12; a is a number having a value from 1 to about 6, preferably from 1.2 to 2.2, and more preferably from 1.5 to 1.7. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Cognis Corporation, Ambler, PA, 19002. Examples of such surfactants include but are not limited to:

1. GLUCOPON® 225DK Surfactant—an alkyl polyglycoside in which the alkyl group contains 8 to 10 carbon atoms and having an average degree of polymerization of 1.7.
2. GLUCOPON® 425N Surfactant—an alkyl polyglycoside in which the alkyl group contains 8 to 16 carbon atoms, having an average of 10.3 carbon atoms, and having an average degree of polymerization of 1.5.
3. GLUCOPON® 625UP Surfactant—an alkyl polyglycoside in which the alkyl group contains 12 to 16 carbon atoms and having an average degree of polymerization of 1.6.
4. APG® 325N Surfactant—an alkyl polyglycoside in which the alkyl group contains 9 to 11 carbon atoms and having an average degree of polymerization of 1.4.
5. GLUCOPON® 600 UP Surfactant—an alkyl polyglycoside in which the alkyl group contains 12 to 16 carbon atoms and having an average degree of polymerization of 1.4.
6. PLANTAREN®2000 Surfactant—a $C_8$–$C_{16}$ alkyl polyglycoside in which the alkyl group contains 8 to 16 carbon atoms and having an average degree of polymerization of 1.5.
7. PLANTAREN® 1300 Surfactant—a $C_{12}$-$C_{16}$ alkyl polyglycoside in which the alkyl group contains 12 to 16 carbon atoms and having an average degree of polymerization of 1.6.
8. GLUCOPON® 220N Surfactant—an alkyl polyglycoside in which the alkyl group contains 8 to 10 carbon atoms and having an average degree of polymerization of 1.5.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2 or mixtures thereof with the polyglycoside having a degree of polymerization of 3 predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 7095% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

The most preferred alkyl polyglycosides for use in the present invention are GLUCOPON® 425 or 425N, which are alkyl polyglycosides in which the alkyl group contains an average of 10.3 carbon atoms, and the average degree of polymerization is 1.5.

The builders that can be used in the concentrates of the invention include one or more of the following: bases, polycarboxylic acid salts, and solubilizers.

The bases that can be used as builders include alkali metal hydroxides, e.g. sodium or potassium hydroxide, alkaline earth metal hydroxides, and amines, especially mono-, di-, or tri-ethanolamine.

The polycarboxylic acid salts that can be used as builders include tetrasodium ethylenediamine tetraacetic acid, (tertasodium EDTA), which is preferred for use herein, or an alkali metal citrate, especially sodium citrate, although other polycarboxylic acid salts can be used instead of, or in addition to, the above, such as other aliphatic di- or tri-carboxylic acid salts, e.g. sodium tartrate, sodium succinate, sodium maleate, sodium malonate, and the like. Also, alkaline earth metal salts or alkanolamine salts, e.g. mono-, di-, or triethanolamine salts of the above polycarboxylic acids can be used instead of the alkali metal salts, provided they possess adequate water solubility and are otherwise compatible with the other components of the concentrate.

The alkali metal hydroxide is preferably sodium or potassium hydroxide.

The solubilizers that can be used as builders include salts, especially alkali metal, e.g. sodium salts, of fatty acid alcohol sulfates, e.g. $C_6$–$C_{12}$ fatty alcohol sulfates. The preferred solubilizer is the sodium salt of n-decyl alcohol sulfate.

The preferred builder for use in the concentrates of the invention is a combination of triethanolamine, tetrasodium EDTA, and the sodium salt of n-decyl alcohol sulfate.

The above concentrates can then be diluted with water to obtain in-use dilutions, e.g. by adding 1 part of the concentrate to from 25 to 60 parts by weight of water.

The concentrates of the invention provide reduced storage and shipping space and expense, since they are highly concentrated. In addition, they contain no volatile organic solvents and hence present no fire or explosion risks. The in-use dilutions have no objectionable odors to consumers, are easy to fragrance, using less fragrance since there are no solvent odors to mask, and exhibit excellent cleaning ability on oily soil, without the use of organic solvents. In addition, the formulation cost of obtaining the in-use dilution from the concentrates is extremely low. They can also be used as all-purpose concentrates, and in hard surface wet wipes.

The invention will be illustrated but not limited to the following examples.

EXAMPLES

Example 1

A free flowing liquid highly concentrated organic solvent-free all-purpose spray cleaner concentrate was prepared by mixing together the following components:

| Component | % by weight | % Active |
|---|---|---|
| water* | 17.00 | — |
| potassium hydroxide (45%) | 6.00 | 2.70 |
| Sodium citrate.$2H_2O$ | 7.50 | 6.58 |
| GLUCOPON ® 425N | 61.65 | 30.83 |
| DEHYPOUND ® ST-15 | 6.85 | 6.85 |
| | 100.0 | 46.96 |

*total water is 53.04% based on 46.96% actives

Example 2

1 part by weight of the concentrate of Example 1 was added to 50 parts by weight of water resulting in the use dilution (test solutions) set forth below, which was obtained without any tendency to gel:

| Component | % by weight | % Active |
|---|---|---|
| water | 98.392 | — |
| Potassium hydroxide (45%) | 0.118 | 0.053 |
| Sodium citrate.$2H_2O$ | 0.147 | 0.129 |
| GLUCOPON ® 425N | 1.209 | 0.605 |
| DEHYPOUND ® ST-15 | 0.134 | 0.134 |
| | 100.00 | 0.921 |

Example 3

The use dilution composition of Example 2 was evaluated for hard surface cleaning performance in a side-by-side comparison with the national brand all purpose spray cleaner FANTASTIK® (test solution) using H7 test soil on Armstrong tiles according to the following method. FANTASTIKO contains 4-5% by weight of the volatile glycol ether solvent, an alkaline builder, and one or more surfactants.

TEST METHOD FOR THE EVALUATION OF HARD SURFACE CLEANING PERFORMANCE

H7 Test Soil composition coated onto 3"×3" Armstrong 56830 Chalk II Vinyl Composite Tiles. The H7 Test Soil Composition was composed of the following components:

| Component | Parts by weight |
|---|---|
| Kerosene | 55 |
| Mineral Oil | 6 |
| Vegetable Oil | 8 |
| Carbon Black | 1.5 |
| Bandy Black Clay | 25 |

Procedure For Soil Application:

0.4 Ml of the above soil composition was applied to the rough side of the above vinyl composite tiles (test panels). The soil was applied with the grain on the panel, using a nylon brush. The panels were dried for 20 minutes at room temperature, then for 20 minutes at 100° C., and then for a final 20 minutes at room temperature.

Cleaning operation (after measuring the reflectance of both the unsoiled tiles and the soiled tiles):

1. Two soiled test panels were placed in a Gardener apparatus wash tray, with the grain parallel to the direction of sponge travel.
2. 200 Ml of test solution was added to the wash tray and left for one minute.

3. The test panels were then scrubbed with a synthetic sponge for 40 cycles. The panels were rotated 90° after 20 cycles.
4. The panels were rinsed with deionized water and dried at room temperature for at least one hour until dry.
5. Steps 1–4 were repeated for a total of 4 test panels for each test solution.

The reflectance of the washed and dried panels was the measured.

The % soil removal was calculated according to the following formula:

$$\% \text{ Soil Removal} = \left\{\frac{Rw - Rs}{Ru - Rs}\right\} \times 100$$

$Rw$ = Reflectance of washed panel $Rs$ = Reflectance of soiled panel $Ru$ = Reflectance of unsoiled panel The results obtained are set forth below:

| | | 1 | 2 | 3 | 4 | AVG | % SR |
|---|---|---|---|---|---|---|---|
| COMPOSITION OF EXAMPLE 2 | Unsoiled | 60.8 | 62.0 | 61.8 | 60.7 | 61.3 | 62.1 |
| | Soiled | 3.1 | 3.1 | 3.1 | 3.1 | 3.1 | |
| | Washed | 39.6 | 42.7 | 36.1 | 38.6 | 39.3 | |
| FANTASTIK ® | Unsoiled | 61.8 | 61.8 | 61.6 | 61.7 | 61.7 | 61.1 |
| | Soiled | 3.1 | 3.1 | 3.1 | 3.1 | 3.1 | |
| | Washed | 39.9 | 41.4 | 40.2 | 34.2 | 38.9 | |

The 90% confidence interval for the method is 2.7% soil removal.

It can be seen that the cleaning performance of the composition of Example 2 of the invention was as good as that of the commercial product FANTASTIK®, despite the fact that the actives content of Example 2 was less than 1% by weight. The actives content of commercial ready to use all purpose spray cleaners such as FANTASTIK® is typically in the range of 6 to 10% by weight.

Example 4

The following volatile organic compound free all purpose cleaner concentrate was prepared by mixing together the following components:

| Component | % by weight | % Active |
|---|---|---|
| GLUCOPON ® 425N | 64.8 | 32.4 |
| DEHYPOUND ® ST-15 | 7.2 | 7.2 |
| Triethanolamine | 10.0 | 10.0 |
| Tetrasodium EDTA | 15.0 | 5.85 |
| SULFOTEX ® 110* | 3.0 | 0.93 |
| total water content | 43.62 | — |

*SULFOTEX ® 110 is a 31% active solution of n-decyl alcohol sulfate, sodium salt.

The above concentrate had a specific gravity of 1.130 and a pH of 11.8.

Example 5

The concentrate of Example 4 was diluted 1 part in 4 parts of water. This 20% solution at 2 ounces per gallon was compared to the commercial brands "MR CLEAN® antibacterial" and "MR. CLEAN® Top Job" at 2 ounces per gallon using the test method set forth in Example 3. The results obtained are set forth below:

Reflectance data from the hard surface detergency evaluation (washed tiles):

| | |
|---|---|
| Concentrate of Example 4 | 71.18 |
| MR. CLEAN ® antibacterial | 65.76 |
| MR. CLEAN ® Top Job | 65.53 |

Example 6

The concentrate of Example 4 was diluted to 5% in water and 2.5% in water and compared to the commercial brand "FANTASTIK®". The results are given below:

Reflectance data from the hard surface detergency evaluation (washed tiles):

| | |
|---|---|
| 5% dilution of the concentrate of Ex. 4 | 82.82 |
| 2.5% dilution of the concentrate of Ex. 4 | 78.16 |
| FANTASTIK ® | 81.19 |

Example 7

The concentrate of Example 4 was diluted to 0.32% in water and compared to the commercial brand glass cleaner "WINDEX™". The results are set forth below:

Reflectance data from the hard surface detergency evaluation (washed tiles):

| | |
|---|---|
| 0.32% dilution of the concentrate of Ex. 4 | 71.09 |
| WINDEX ®* | 72.15 |

*contains isopropyl alcohol

What is claimed is:

1. An aqueous liquid concentrate for use when diluted as an all purpose spray cleaner comprising the following components:

A) from about 3 to about 10% by weight of at least one base-catalyzed reaction product comprised of the following reactants:

(i) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and (ii) at least one compound having the formula II $$R^2X(AO)_nY \quad \text{(II)}$$

wherein $R^2$ is a substituted or unsubstituted, saturated or unsaturated, organic group having from 1 to 36 carbon atoms; X is —O—, —S—, or —$NR^3$— where $R^3$ is hydrogen or a $C_1$–$C_{18}$, alkyl group; each AO group is independently an ethyleneoxy, 1,2-propyleneoxy, or 1,2-butyleneoxy group, n is number of from 0 to 200; and Y is hydrogen, or Y can be a mercapto group, an amino group, or a $C_1$–$C_6$ alkylamino group in place of a terminal —OH group, provided that when Y is mercapto, amino, or a $C_1$–$C_6$ alkylamino group, n is at least 1;

B) from about 15 to about 45% by weight of at least one alkyl polyglycoside;

C) from about 3 to about 20% by weight of one or more builders provided that the total quantity of nonaqueous components is from about 25 to about 60% by weight; and wherein the concentrate does not contain any volatile organic solvents.

2. The concentrate of claim 1 wherein the total quantity of nonaqueous components is from about 40 to about 50% by weight.

3. The concentrate of claim 1 wherein component A) is present in from about 5 to about 8 parts by weight, component B) is present in from about 25 to about 35 parts by weight, component C) is present in from about 9 to about 18 parts by weight.

4. The concentrate of claim 1 wherein component B) has the following formula:

$$R_1O(R_2O)_b(Z)_a \quad \text{(IV)}$$

wherein $R^1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; and a is a number having a value from 1 to about 6.

5. The concentrate of claim 4 wherein in formula IV, Z is a glucose residue and b is zero.

6. The concentration of claim 1 wherein the mole ratio of component A) i) to A) ii) is from about 0.1:1 to about 5:1.

7. The concentrate of claim 6 wherein said mole ratio is from about 0.8:1 to about 2:1.

8. The concentrate of claim 6 wherein said mole ratio is from about 1.0:1 to about 1.5:1.

9. The concentrate of claim 1 wherein component A) i) is epichlorohydrin.

10. The concentrate of claim 1 wherein in formula II, n is a number of from 1 to 100.

11. The concentrate of claim 10 wherein n is a number of from 2 to 20.

12. The concentrate of claim 1 wherein in component A) ii) the $R^2$ group is a straight or branched chain alkyl group.

13. The concentrate of claim 12 wherein in component A) ii) n is a number from 2 to 20.

14. The concentrate of claim 1 wherein component A) ii) has the formula:

$$R^2O(EO)_m(PO)_p(BO)_qH \quad \text{(II)}$$

wherein $R^2$ has the meaning given in claim 1, m is a number of from 0 to 100, p is a member of from 0 to 50, and q is a number of from 0 to 50.

15. The concentrate of claim 14 wherein component A) i) is epichlorohydrin.

16. The concentrate of claim 14 wherein the mole ratio of component A) i) to component A) ii) is from about 0.1:1 to about 5:1.

17. The concentrate of claim 16 wherein said mole ratio is from about 0.8:1 to about 2:1.

18. The concentrate of claim 16 wherein said mole ratio is from about 1.0: to about 1.5:1.

19. The concentrate of claim 14 wherein m is a number of from 2 to 20.

20. The concentrate of claim 19 wherein p and q=0.

21. The concentrate of claim 16 wherein $R^2$ is an alkyl group having from 4 to 12 carbon atoms.

22. The concentrate of claim 14 wherein $R^2$ is an alkyl group having from 4 to 12 carbon atoms, m is a number of from 4 to 50, and p and q=0.

23. The concentrate of claim 1 wherein component A) is the reaction product of isodecyl alcohol—4EO and epichlorohydrin, component B) is an alkyl polyglycoside wherein the alkyl group has an average of from about 10 to about 10.5 carbon atoms and an average degree of polymerization of from 1.5 to 1.7; and component C) is a combination of a base and a polycarboxylic acid salt.

24. The concentrate of claim 23 wherein in component B) the alkyl group has an average of about 10.3 carbon atoms and the average degree of polymerization is about 1.6.

25. The concentrate of claim 23 wherein component C) also contains a solubilizer.

26. The concentrate of claim 25 wherein the solubilizer is an alkali metal salt of a fatty alcohol sulfate.

27. The concentrate of claim 23 wherein component C) is a combination of triethanolamine, tetrasodium ethylenediamine tetraacetic acid, and the sodium salt of n-decyl alcohol sulfate.

28. The concentrate of claim 27 wherein component A) is present in about 7.2%, component B) is present in about 32.4%, and component C) consists of about 10.0% triethanolamine, about 5.8% tetrasodium ethylenediamine tetraacetic acid, and about 0.9% of the sodium salt of n-decyl alcohol sulfate.

29. An all purpose spray cleaner which consists essentially of the concentrate of claim 1 diluted to a use concentration.

30. The spray cleaner of claim 29 wherein the concentrate is diluted with from 25 to 60 parts of water per part of concentrate.

31. An all purpose spray cleaner which consists essentially of the concentrate of claim 5 diluted to a use concentration.

32. An all purpose spray cleaner which consists essentially of the concentrate of claim 28 diluted to a use concentration.

33. A method for cleaning a hard surface comprising the steps of:

I) applying to the hard surface a cleaner composition free from volatile organic solvents, wherein the cleaner composition is an in-use dilution of an aqueous liquid concentrate comprising the following components:

A) from about 3 to about 10% by weight of at least one base-catalyzed reaction product comprised of the following reactants:

(i) at least one compound of formula I $$R^1(X)_3 \quad \text{(I)}$$

wherein each X group is a halogen atom or one X group is a halogen atom and two X groups represent an epoxy oxygen atom, which is attached to two adjacent carbon atoms in the $R^1$ group to form an epoxy group, and $R^1$ is an alkanetriyl group containing from 3 to 10 carbon atoms; and (ii) at least one compound having the formula II $$R^2X(AO)_nY \quad \text{(II)}$$

wherein $R^2$ is a substituted or unsubstituted, saturated or unsaturated, organic group having from 1 to 36 carbon atoms, X is —O—, —S—, or —$NR^3$— where $R^3$ is hydrogen or a $C_1$–$C_{18}$ alkyl group; each AO group is independently an ethyleneoxy, 1,2-propyleneoxy or 1,2-butyleneoxy group, n is a number of from 0 to 200; and Y is hydrogen, or Y can be a mercapto group, an amino group, or a $C_1$–$C_6$ alkylamino group in place of a terminal —OH group, provided that when Y is mercapto, amino, or a $C_1$–$C_6$ alkylamino group, n is at least 1;

B) from about 15 to about 45% by weight of at least one alkyl polyglycoside;

C) from about 3 to about 20% by weight of one or more builders; provided that the total quantity of nonaqueous components in the aqueous liquid concentrate is from about 25 to about 60% by weight; wherein the concentrate does not contain any volatile organic solvents;

II) removing the cleaner composition from the hard surface.

34. The method of claim 33 wherein step I) is carried out by spraying the cleaner composition onto the hard surface.

35. The method of claim 33 wherein in step I) the cleaner composition is a dilution of from about 25 to about 60 parts of water per part of aqueous liquid concentrate.

36. The method of claim 33 wherein the total quantity of nonaqueous components in said concentrate is from about 40 to about 50% by weight.

37. The method of claim 33 wherein component A) is present in from about 5 to about 8 parts by weight, component B) is present in from about 25 to about 35 parts by weight, component C) is present in from about 9 to about 18 parts by weight.

38. The method of claim 33 wherein component B) has the following formula:

$$R_1O(R_2O)_b(Z)_a \quad \text{(IV)}$$

wherein $R_1$ is monovalent organic radical having from about 6 to about 30 carbon atoms; $R^2$ is divalent alkylene radical having from 2 to 4 carbon atoms; Z is a saccharide residue having 5 or 6 carbon atoms; b is a number having a value from 0 to about 12; and a is a number having a value from 1 to about 6.

39. The method of claim 38 wherein in formula (IV), Z is a glucose residue and b is zero.

40. The method of claim 33 wherein the mole ratio of component A)i) to A)ii) is from about 0.1:1 to about 5:1.

41. The method of claim 40 wherein said mole ratio is from about 0.8:1 to about 2:1.

42. The method of claim 40 wherein said mole ratio is from about 1.0:1 to about 1.5:1.

43. The method of claim 33 wherein component A)i) is epichlorohydrin.

44. The method of claim 33 wherein in formula II, n is a number of from 1 to 100.

45. The method of claim 44 wherein n is a number of from 2 to 20.

46. The method of claim 33 wherein in component A)ii) the $R^2$ group is a straight or branched chain alkyl group.

47. The method of claim 46 wherein in component A)ii) n is a number from 2 to 20.

48. The method of claim 33 wherein component A)ii) has the formula:

$$R^2O(EO)_m(PO)_p(BO)_qH \quad \text{(II)}$$

wherein $R^2$ has the meaning given in claim 33, m is a number of from 0 to 100, p is a number of from 0 to 50, and q is a number of from 0 to 50.

49. The method of claim 48 wherein component A)i) is epichlorohydrin.

50. The method of claim 48 wherein the mole ratio of component A)i) to component A)ii) is from about 0.1:1 to about 5:1.

51. The method of claim 50 wherein the mole ratio is from about 0.8:1 to about 2:1.

52. The method of claim 50 wherein said mole ratio is from about 1.0:1 to about 1.5:1.

53. The method of claim 48 wherein m is a number of from 2 to 20.

54. The method of claim 53 wherein p and q=0.

55. The method of claim 48 wherein $R^2$ is an alkyl group having from 4 to 12 carbon atoms.

56. The method of claim 48 wherein $R^2$ is an alkyl group having 4 to 12 carbon atoms, m is a number of from 4 to 50, and p and q=0.

* * * * *